US008088117B2

(12) United States Patent
Stephens et al.

(10) Patent No.: US 8,088,117 B2
(45) Date of Patent: Jan. 3, 2012

(54) FILL PORT FOR A FLEXIBLE CONTAINER FOR RELIEVING OR DISTRIBUTING STRESSES AT THE FILL PORT

(75) Inventors: Thomas Charles Stephens, Braselton, GA (US); Edward Warren Trainer, Jefferson, GA (US)

(73) Assignee: Nicolon Corporation, Norcross, GA (US)

( * ) Notice: Subject to any disclaimer, the term of this patent is extended or adjusted under 35 U.S.C. 154(b) by 0 days.

(21) Appl. No.: 11/258,525

(22) Filed: Oct. 25, 2005

(65) Prior Publication Data

US 2007/0093776 A1 Apr. 26, 2007

(51) Int. Cl.

| | |
|---|---|
| ***A61M 5/32*** | (2006.01) |
| *A61B 19/00* | (2006.01) |
| *A61M 25/00* | (2006.01) |
| *A61M 31/00* | (2006.01) |
| *F16K 15/20* | (2006.01) |
| *F16L 23/00* | (2006.01) |
| *B65B 1/04* | (2006.01) |
| *B65B 3/04* | (2006.01) |

(52) U.S. Cl. ..... 604/411; 604/408; 604/415; 604/416; 604/264; 604/272; 604/275; 604/277; 137/223; 137/226; 285/414; 285/413; 141/10; 141/313; 141/314; 141/333; 141/346; 347/348; 347/383

(58) Field of Classification Search ..... 604/411, 604/408, 415, 416, 264, 272, 275, 277; 137/223, 137/226; 141/10, 313, 314, 333, 346, 347, 141/348, 383

See application file for complete search history.

(56) References Cited

U.S. PATENT DOCUMENTS

| | | | | |
|---|---|---|---|---|
| 649,415 | A | | 5/1900 | Shaffer |
| 1,623,107 | A | | 4/1927 | Goodykoontz |
| 1,798,094 | A | | 3/1931 | Malvern et al. |
| 2,273,398 | A | * | 2/1942 | Couty et al. ..... 285/222.3 |
| 2,323,629 | A | | 7/1943 | Spanel |
| 2,620,852 | A | | 12/1952 | Forbush |

(Continued)

FOREIGN PATENT DOCUMENTS

| | | |
|---|---|---|
| EP | 0267661 | 5/1988 |

(Continued)

OTHER PUBLICATIONS

PCT/US03/41791 International, Search Report May 18, 2004.

(Continued)

*Primary Examiner* — Leslie Deak
*Assistant Examiner* — Adam Marcetich
(74) *Attorney, Agent, or Firm* — Kilpatrick Townsend & Stockton LLP

(57) ABSTRACT

Methods, systems, and apparatus for a fill port for a flexible container such as a flexible self supporting dewatering or marine structure. The container includes a flexible material having at least one opening and a fill port having an inner port body and an outer port body. At least one face of the inner and/or outer port body has a plurality of cellular surfaces with cavities that do not extend through the inner and/or outer port body on which they are positioned. The cavities receive a portion of the flexible material when the inner port body, the flexible material, and the outer port body are secured together and in use, thus minimizing stresses on the flexible material surrounding the fill port by equally distributing the forces acting on this material during the filling stage and thus reducing the risk of tears or failure to the flexible container.

28 Claims, 5 Drawing Sheets

U.S. PATENT DOCUMENTS 2,874,697 A * 2/1959 Johnson ..... 604/340
3,122,297 A 2/1964 Sachs
3,643,440 A 2/1972 Knisse et al.
3,886,751 A 6/1975 Labora
4,036,674 A 7/1977 Labenz
4,040,526 A * 8/1977 Baxter et al. ..... 410/119
4,049,034 A 9/1977 Vcelka et al.
4,146,069 A * 3/1979 Angarola et al. ..... 141/68
4,150,848 A * 4/1979 Dyrup ..... 285/238
4,183,550 A * 1/1980 Sudou ..... 280/728.2
4,295,670 A 10/1981 Goodall et al.
4,327,726 A 5/1982 Kwong et al.
4,445,551 A 5/1984 Bond et al.
4,500,153 A * 2/1985 Mattingly et al. ..... 439/313
4,702,274 A 10/1987 Kramer
4,768,563 A 9/1988 Kogge et al.
4,772,134 A 9/1988 Jensen et al.
4,772,152 A 9/1988 Gill
4,796,676 A * 1/1989 Hendershot et al. ..... 141/83
4,802,694 A 2/1989 Vargo
4,817,824 A 4/1989 LaFleur et al.
4,830,401 A * 5/1989 Honda ..... 280/736
4,925,216 A * 5/1990 Steer ..... 285/3
4,966,491 A * 10/1990 Sample ..... 405/19
4,988,119 A * 1/1991 Hartmeyer ..... 280/728.2
5,023,987 A 6/1991 Wuepper et al.
5,034,254 A 7/1991 Cologna et al.
5,059,065 A 10/1991 Doolaege
5,072,623 A * 12/1991 Hendershot ..... 73/49.2
5,121,996 A 6/1992 Scarrow
5,131,677 A * 7/1992 Horiuchi et al. ..... 280/731
5,158,395 A 10/1992 Holmberg
5,308,107 A * 5/1994 Watanabe et al. ..... 280/728.2
5,397,020 A * 3/1995 Witt ..... 73/49.2
5,465,768 A 11/1995 DeRoos et al.
5,481,790 A 1/1996 Koreis et al.
5,505,557 A 4/1996 Bradley
5,651,403 A 7/1997 Andersen
5,669,732 A 9/1997 Truitt
D393,322 S 4/1998 Suttles
5,826,919 A 10/1998 Bravo et al.
5,851,072 A * 12/1998 LaFleur ..... 383/66
5,853,247 A * 12/1998 Shroyer ..... 383/95
5,902,070 A 5/1999 Bradley
6,013,343 A 1/2000 Radke et al.
6,056,438 A 5/2000 Bradley
6,179,521 B1 1/2001 Muramatsu et al.
6,186,701 B1 2/2001 Kempers
6,200,067 B1 3/2001 Pena
6,264,251 B1 7/2001 Kunsman et al.
6,460,783 B1 * 10/2002 Christopher ..... 239/394
6,575,629 B1 6/2003 Perkins
6,623,214 B1 * 9/2003 Hauske et al. ..... 405/302.7
6,739,274 B2 * 5/2004 Eagles et al. ..... 114/74 T
2001/0009258 A1 7/2001 Wakayama
2002/0030055 A1 * 3/2002 Maturana ..... 220/495.06
2002/0131827 A1 9/2002 Spangler et al.
2004/0000792 A1 * 1/2004 Carhuff ..... 285/414
2005/0126874 A1 * 6/2005 Back et al. ..... 192/3.3
2006/0165320 A1 7/2006 Stephens

FOREIGN PATENT DOCUMENTS

EP 1350892 10/2003
JP 2-164925 6/1990
WO WO 01/11148 A1 2/2001
WO WO-2004061241 7/2004
WO WO-2007050540 5/2007

OTHER PUBLICATIONS

PCT/US06/41354 International, Search Report and Written Opinio n. Jan. 10, 2008.

* cited by examiner

FILL PORT FOR A FLEXIBLE CONTAINER FOR RELIEVING OR DISTRIBUTING STRESSES AT THE FILL PORT

FIELD OF THE INVENTION

The invention generally relates to systems and methods for a flexible self supporting dewatering structure. More specifically, the invention relates to methods, systems, and apparatus for a fill port for a flexible container such as a flexible self supporting dewatering structure.

BACKGROUND OF THE INVENTION

Conventional filter media, flexible containers, and flexible self supporting dewatering structures (FSSDS) can be fabricated with various textile materials exhibiting relatively high tensile strength to provide sufficient durability, flexibility, and wear-resistance during use. Such filter media, flexible containers, and FSSDS can be used for forming a core or a base of a dam, quay, bank reinforcement, a jetty, or a breakwater. Such filter media, flexible containers, and FSSDS can also be utilized for filling holes or trenches, for the packaging and storage of contaminated material, or other uses. One example of a filter media, flexible container, or FSSDS is described in U.S. Pat. No. 6,186,701 B1, entitled "Elongate Flexible Container," the contents of which are hereby incorporated by reference.

One or more fill ports can be utilized to supply a flow of filling material to an associated filter media, flexible container, or FSSDS. Such fill ports can be installed or otherwise mounted to the textile material of the filter media, flexible container, or FSSDS. One drawback of some conventional fill ports is that the installation of such fill ports can create one or more stress concentration points in the textile material around the fill port. These stress concentration points around a fill port can arise when the associated filter media, flexible container, or FSSDS is subjected to dynamic loading, such as during filling the filter media, flexible container, or FSSDS with a filling material. Such stress concentration points around a fill port can lead to tears or failure of the textile material during use of the filter media, flexible container, or FSSDS. Tears or failure of the textile material can require expensive and time consuming repairs, or sometimes replacement of some or all of the filter media, flexible container, or FSSDS. Thus, avoiding such tears or failures around the fill port can require conservative operation of the filter media, flexible container, or FSSDS while loading or filling the media, container, or FSSDS, which may in some cases, be significantly less than the design loading or filling capacity of the textile material comprising the filter media, flexible container, or FSSDS.

Therefore, a need exists for methods, systems, and apparatus for an improved fill port for a flexible container.

A need exists for methods, systems, and apparatus for increasing the dynamic loading capacity of a flexible container with a fill port.

A further need exists for methods, systems, and apparatus for reducing tears or failures of a surface near a fill port for a flexible container.

SUMMARY OF THE INVENTION

The terms "flexible container," "filter media," "flexible self supporting dewatering structure," and "FSSDS" can be used interchangeably within this specification. The present invention addresses the needs described above. A fill port according to an embodiment of the invention can be installed on a flexible container. The fill port can be used to fill the flexible container with a fill material supplied from an external pump or supply system. The fill port can be adapted with various connectors or other devices to permit mating or coupling of the fill port with a feed line associated with an external pump or supply system. The fill port allows for an increase in the dynamic loading capacity of a flexible container since the design of the fill port reduces the possibility of tears or failures of the flexible container surface near the fill port.

One embodiment of the present invention can include a method for providing a fill port for a flexible container. The method can include mounting an inner port body to one side of a flexible material associated with a container, wherein the inner port body is capable of receiving a fill material. The method can also include mounting an outer port body to an opposing side of the flexible material, wherein the outer port body is capable of transferring the fill material to the inner port body. Furthermore, the method can include advancing a portion of the inner port body towards a portion of the outer port body, wherein a portion of the flexible material is positioned relative to and between the inner port body and the outer port body, Moreover, the method can include creating at least one opening in the flexible material to permit the fill material to be transferred through the outer port body, the at least one opening, and the inner port body.

In one embodiment, the inner port body and outer port body comprise corresponding flat ring-shaped structures.

In another embodiment, the corresponding flat ring-shaped structures each comprise one or more cellular surfaces.

In another embodiment, advancing a portion of the inner port body towards a portion of the outer port body comprises use of at least one of the following devices: bolt, clamp, adhesive, weld, or rivet.

In another embodiment, advancing a portion of the inner port body towards a portion of the outer port body comprises clamping the portion of the flexible material relative to the inner port body and outer port body.

In another embodiment, creating at least one opening in the flexible material to permit the fill material to be transferred through the inner port body comprises cutting a portion of the flexible material clamped between the inner port body and the outer port body.

In another embodiment, the method can include mounting an inner gasket between the inner port body and the one side of the flexible material; and mounting an outer gasket between the outer port body and the opposing side of the flexible material.

In another embodiment, the method can include mounting a flow line to the outer port body, wherein the flow line is capable of providing the fill material to the outer port body and to the flexible container.

In another embodiment, the flexible material comprises a flexible fabric such as an engineered textile.

Another embodiment of the invention can include a combination of a fill port and a flexible container. In this embodiment, the flexible container can include a flexible material with at least one opening. The combination can include an inner port body capable of mounting to one side of the flexible material and adjacent to the at least one opening, wherein inner port body is capable of receiving a fill material from the at least one opening. The combination can also include an outer port body capable of mounting to an opposing side of the flexible material adjacent to the at least one opening, wherein outer port body is capable of transferring the fill material to the at least one opening. Furthermore, the combination can include means for advancing the inner port body towards the outer port body towards each other, wherein the flexible material is positioned relative to the inner port body and outer port body, and transfer of the fill material can be facilitated through the outer port body, the at least one opening, and to the inner port body.

In another embodiment, the inner port body and outer port body comprise corresponding flat ring-shaped structures.

In another embodiment, the inner port body and outer port body each comprise one or more cellular surfaces capable of distributing a force caused by the clamping of the inner port body and outer port body together.

In another embodiment, means for advancing the inner port body towards the outer port body comprises at least one of the following devices: bolt, clamp, adhesive, weld, or rivet.

In another embodiment, means for advancing the inner port body towards the outer port body causes the portion of the flexible material to be clamped relative to the inner port body and outer port body.

In another embodiment, the at least one opening in the flexible material is facilitated by cutting a portion of the flexible material.

In another embodiment, the combination can include an inner gasket capable of mounting between the inner port body and the one side of the flexible material, and an outer gasket capable of mounting between the outer port body and the opposing side of the flexible material.

In another embodiment, the combination can include a flow line capable of mounting to the outer port body, wherein the flow line is capable of providing the fill material to the outer port body and the flexible container.

In another embodiment, the combination can include a sleeve capable of mounting to the outer port body, and further capable of mounting to a flow line, wherein a fill material can be transmitted from the flow line, through the sleeve, and to the outer port body.

In another embodiment, the flexible material comprises a flexible fabric such as an engineered textile.

Furthermore, another embodiment of the invention can include a method for using a fill port for a flexible container. The method can include providing a fill port for a flexible container. The fill port can include an inner port body capable of mounting to one side of a flexible material, wherein inner port body is capable of receiving a fill material from the at least one opening. The fill port can also include an outer port body capable of mounting to an opposing side of the flexible material, wherein outer port body is capable of transferring the fill material to the at least one opening. Furthermore, the fill port can include means for advancing the inner port body towards the outer port body, wherein the flexible material is positioned relative to the inner port body and outer port body, and transfer of the fill material can be facilitated through the outer port body, the opening, and the inner port body. The method can also include advancing the inner port body towards the outer port body, wherein a portion of the flexible material is clamped relative to the inner port body and the outer port body. Furthermore, the method can include securing a positions of the inner port body and a portion of the outer port body. Moreover, the method can include facilitating at least one opening in the flexible material capable of permitting the fill material to be transferred through the outer port body, the at least one opening, and to the inner port body. The method can also include pumping the fill material through the outer port body, the at least one opening, and the inner port body.

In another embodiment, the inner port body and outer port body comprise corresponding flat ring-shaped structures.

In another embodiment, the inner port body and outer port body each comprise one or more cellular surfaces capable of distributing a force caused by the clamping of the inner port body and outer port body together.

In another embodiment, means for advancing the inner port body towards the outer port body comprises at least one of the following devices: bolt, clamp, adhesive, weld, or rivet.

In another embodiment, advancing the inner port body towards the outer port body causes the flexible material to be positioned between the inner port body and outer port body.

In another embodiment, the at least one opening in the flexible material is facilitated by cutting a portion of the flexible material.

In another embodiment, the fill port further comprises: an inner gasket capable of mounting between the inner port body and the one side of the flexible material; and an outer gasket capable of mounting between the outer port body and the opposing side of the flexible material.

In another embodiment, the fill port further comprises: a flow line capable of mounting to the outer port body, wherein the flow line is capable of providing the fill material to the outer port body and to the flexible container.

In another embodiment, the fill port further comprises: a sleeve capable of mounting to the outer port body, and further capable of receiving a fill material from a flow line, wherein the fill material can be transmitted from the flow line, through the sleeve, and to the outer port body.

In another embodiment, the flexible material comprises a flexible fabric such as an engineered textile.

Yet another embodiment of the invention can include an apparatus for providing a fill port for a flexible container. The flexible container can include a flexible material and an opening. The apparatus can include an inner port body capable of mounting to one side of the flexible material and adjacent to the opening, wherein inner port body is capable of receiving a fill material from the opening. The apparatus can include an outer port body capable of mounting to an opposing side of the flexible material adjacent to the opening, wherein outer port body is capable of transferring the fill material to the opening. Furthermore, the apparatus can include means for advancing the inner port body towards the outer port body, wherein the flexible material is positioned between the inner port body and outer port body, and transfer of the fill material can be facilitated through the outer port body, the at least one opening, and to the inner port body.

In another embodiment, the inner port body and outer port body comprise corresponding flat ring-shaped structures.

In another embodiment, the inner port body and outer port body each comprise one or more cellular surfaces capable of distributing a force caused by the clamping of the inner port body and outer port body together.

In another embodiment, means for advancing the inner port body towards the outer port body comprises at least one of the following devices: bolt, clamp, adhesive, weld, or rivet.

In another embodiment, means for advancing the inner port towards the outer port body causes the portion of the flexible material to be clamped in a position relative to the inner port body and outer port body.

In another embodiment, the opening in the flexible material is facilitated by cutting a portion of the flexible material.

In another embodiment, the apparatus can include an inner gasket capable of mounting between the inner port body and the one side of the flexible material, and an outer gasket capable of mounting between the outer port body and the opposing side of the flexible material.

In another embodiment, the apparatus can include a flow line capable of mounting to the outer port body, wherein the flow line is capable of providing the fill material to the outer port body and the flexible container.

In another embodiment, the apparatus can include a sleeve capable of mounting to the outer port body, and further capable of mounting to a flow line, wherein a fill material can be transmitted from the flow line, through the sleeve, and to the outer port body.

In another embodiment, the flexible material comprises a flexible fabric such as an engineered textile.

Objects, features and advantages of various systems, methods, and apparatuses according to various embodiments of the invention can include:

(1) Providing a fill port for a flexible container such as a flexible self supporting dewatering structure;

(2) Installing a fill port for a flexible container such as a flexible self supporting dewatering structure; and (3) Using a fill port for a flexible container such as a flexible self supporting dewatering structure.

Other objects, features and advantages of various aspects and embodiments according to the invention are apparent from the other parts of this document.

BRIEF DESCRIPTION OF THE DRAWINGS

These and other features, aspects, and advantages of the present invention are better understood when the following Detailed Description is read with reference to the accompanying drawings, wherein.

DETAILED DESCRIPTION OF DISCLOSED EMBODIMENTS

Figure 1:
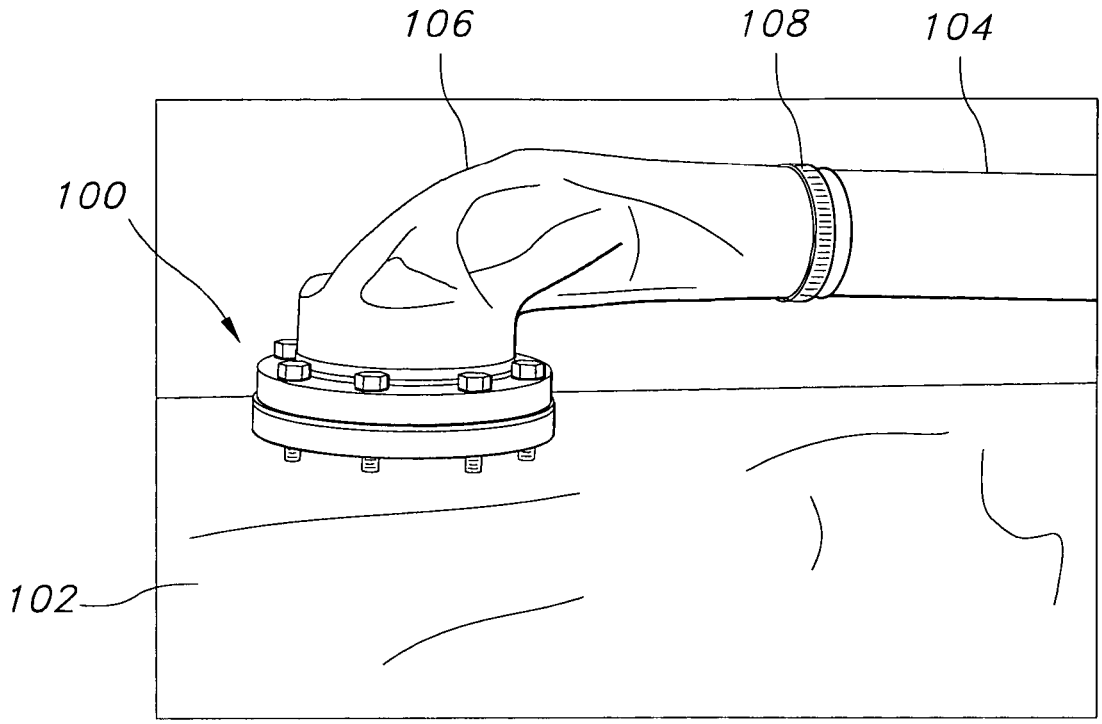
FIG. 1 illustrates an example of a fill port operating in conjunction with a flexible container in accordance with an embodiment of the invention.

FIG. 1 illustrates an example of a fill port capable of operating in conjunction with a flexible container in accordance with an embodiment of the invention. The fill port 100 shown in FIG. 1 can be mounted with respect to a filter media or flexible container, such as 102. Note that the fill port 100 is shown for illustration purposes and is not shown mounted to the flexible container 102. The fill port 100 can provide an improved port for filling a filter media or flexible container with a filling material. A suitable flexible container for use with a fill port in accordance with the present invention is a Geotube® GT500 geotextile container.

One or more filling materials can be provided by a pump or supply system (not shown). The filling materials can be transmitted via a feed line 104 through a fabric sleeve 106 and the fill port 100, and to the flexible container 102. One end of the fabric sleeve 106 can mount to the fill port 100, and the other end of the fabric sleeve 106 can mount to the feed line 104. One or more clamps 108 or other devices can secure the position of the fabric sleeve 106 relative to the feed line 104. Some or all of the components, such as the fabric sleeve 106, clamp 108, and feed line 104, can be associated with a pump or a supply system (not shown) for providing one or more filling materials to the fill port 100 and flexible container 102.

In other embodiments, various types and shapes of feed lines can be implemented with a fill port in accordance with the invention. The fill port can be adapted to mate or couple with a feed line or other devices associated with a external pump or supply system. The fill port can be adapted with various connectors or other devices to facilitate mating or coupling of a feed line to the fill port. For example, a 4 inch diameter feed line with at least two 90 degree elbows can be mounted to a fill port with a corresponding inner diameter, wherein a discharge end of the feed line can discharge a fill material into an associated flexible container. In another example, a 6 inch diameter feed line can be mounted to a fill port with a corresponding inner diameter, wherein a discharge end of the feed line can discharge a fill material into an associated flexible container. In yet another embodiment, a fabric sleeve and clamp assembly, such as 106 and 108, can be used to connect a feed line, such as 104, with a fill port. A fill port with a fabric sleeve can be closed when the fill port is not in use, and reopened when needed. For example, a fabric sleeve such as 106 may be closed off by rolling up or otherwise clamping the fabric together to prevent further ingress or egress of a fill material through the fill port.

The fill port 100 shown can include an inner port body, an outer port body, an inner gasket, an outer gasket, and a series of connection bolts and corresponding nuts. In other embodiments, some or all of these components can be utilized in accordance with the invention. The components of the fill port 100 shown in FIG. 1 are described in greater detail below.

Figure 2:
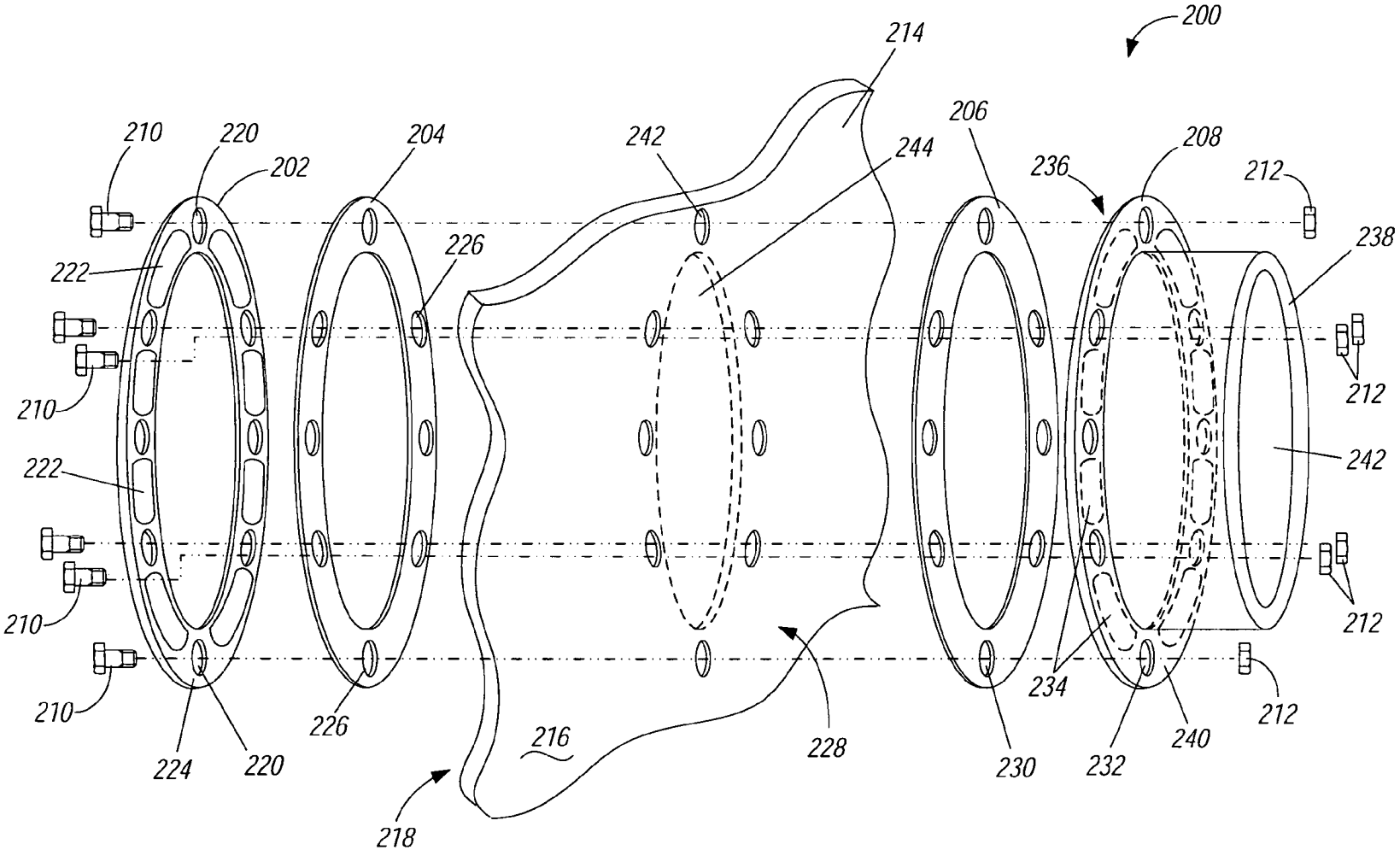
FIG. 2 illustrates an exploded view of an example of a fill port in accordance with an embodiment of the invention.

FIG. 2 illustrates an exploded view of a fill port 200 in accordance with an embodiment of the invention. The fill port 200 can include an inner port body 202, an inner gasket 204, an outer gasket 206, an outer port body 208, and a set of connection bolts 210 and corresponding nuts 212. As shown in FIG. 2, the fill port 200 can mount with respect to a surface 214 of a flexible container 216. For example, one suitable surface for mounting a fill port for a flexible container can be a textile material such as an engineered textile. Other components and configurations for a fill port can exist in accordance with other embodiments of the invention.

Figure 3:
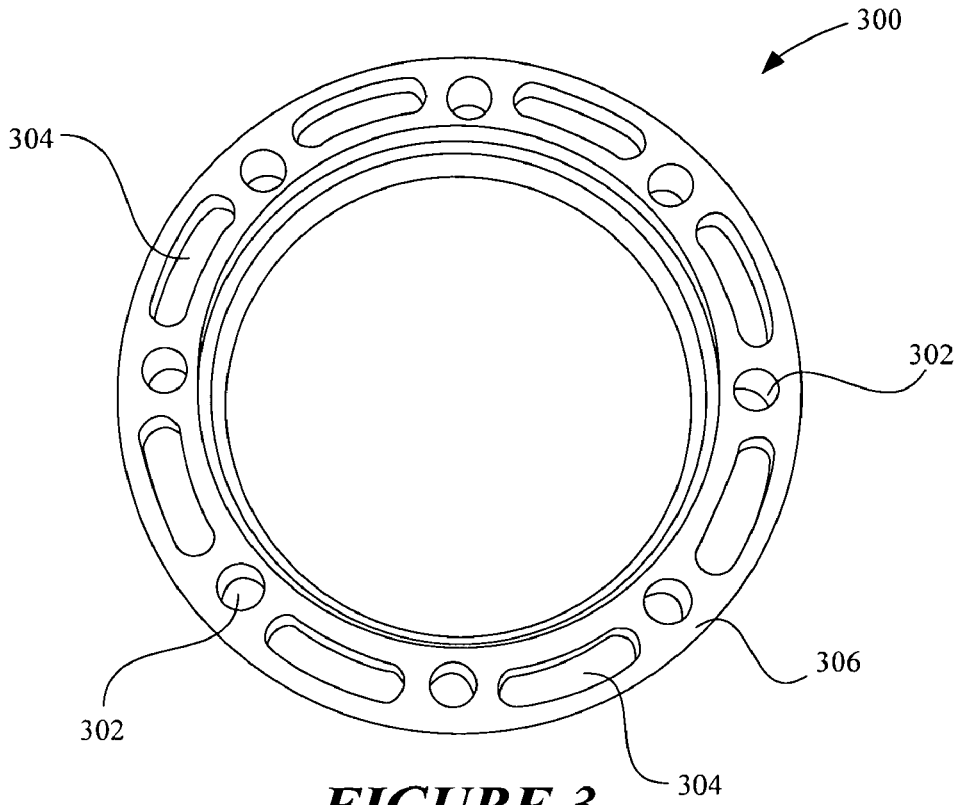
FIG. 3 illustrates an example of an inner port body of a fill port according to one embodiment of the invention.

The inner port body 202, 300 shown in FIGS. 2 and 3 is capable of mounting to an internal surface of a flexible container. For example in FIG. 2, the inner port body 202 can mount to an inner surface 218 of the flexible container 216. In the embodiments shown in FIGS. 2 and 3, an inner port body 202, 300 can be a circular-shaped ring or flange-shaped piece. The inner port body 202, 300 can be relatively flat with a relatively consistent circumferential thickness, and can include a series of relatively evenly spaced apart bolt holes 220, 302 machined through the inner port body 202, 300. Between each of the respective bolt holes 220, 302, one or more cellular surfaces 222, 304 can also be machined or otherwise molded into an inner face 224, 306 of the inner port body 202, 300. The cellular surfaces 222, 304 may be uniformly distributed between the bolt holes 220, 302 of the inner port body 202, 300 as shown in FIGS. 2 and 3. The "inner face" is defined herein as the surface of the inner port body facing the portion of material of the flexible container that will be clamped relative to and between the inner port body and the outer port body.

In one embodiment, an inner port body can be a ring-shaped flange approximately 1.5 inches (38 mm) thick. The inner diameter of this embodiment of an inner port body can be approximately 8 inches (203 mm) and the outer diameter can be approximately 12 inches (300 mm). Other embodiments of an inner port body can have greater or lesser dimensions in accordance with the invention.

In the embodiment shown in FIGS. 2 and 3, each of the cellular surfaces 222, 304 is a cavity or recess or groove provided (such as via machining) in the surface of the inner face 224 of the inner port body 202, 300. As shown in FIG. 2, the cellular surfaces 222, 304 preferably do not extend all the way through the inner port body 202, 300. The cellular surfaces 222, 304 shown can have a consistent depth across the length and width of each surface 222, 304. For example, a cellular surface can have an approximate depth of 0.5 inches (13 mm). In other embodiments, the cellular surfaces can comprise cavities, recesses, or grooves of consistent or differing shapes and sizes, or combinations thereof. Moreover, in other embodiments, the depth of a cellular surface within a particular inner port body can vary, or a single cellular surface can have varying depths within the associated inner face of an inner port body, or any combination thereof.

The inner gasket 204 shown in FIG. 2 is capable of mounting between an inner face of an inner port body and a surface of a flexible container. The inner gasket 204 is a relatively smooth and flexible piece, and is capable of transferring some or all of the clamping or gripping force from the inner port body 202 to the inner surface 218 of the flexible container 216 without damaging the surface of the flexible container 216. For example, the inner gasket 204 can mount between the inner face 224 of the inner port body 202 and the inner surface 218 of the flexible container 216. In the embodiment shown in FIG. 2, an inner gasket 204 can be circular-shaped ring. The inner gasket 204 can be relatively flat with a relatively consistent circumferential thickness, and can include a series of relatively evenly spaced apart bolt holes 226 machined through the inner gasket 204. One suitable material for an inner gasket is neoprene. Other suitable materials for an inner gasket can include, but are not limited to, rubber, or neoprene.

In one embodiment, an inner gasket can be a neoprene ring-shaped piece approximately 0.125 inches (3.2 mm) thick. The inner diameter of this embodiment of an inner gasket can be approximately 8 inches (200 mm) and the outer diameter can be approximately 12 inches (300 mm). Other embodiments of an inner gasket can have greater or lesser dimensions in accordance with the invention.

The outer gasket 206 shown in FIG. 2 is capable of mounting an inner face of an outer port body and a surface of a flexible container. The outer gasket 206 is a relatively smooth and flexible piece, and is capable of transferring some or all of the clamping or gripping force from the outer port body 208 to the outer surface 228 of the flexible container 216 without damaging the surface of the flexible container 216. For example in FIG. 2, the outer gasket can mount between the inner face 236 of the outer port body 208 and an outer surface 228 of the flexible container 216. In the embodiment shown in FIG. 2, an outer gasket 206 can be circular ring-shaped. The outer gasket 206 can be relatively flat with a relatively consistent circumferential thickness, and can include a series of relatively evenly spaced apart bolt holes 230 machined through the outer gasket 206. One suitable material for an outer gasket is neoprene. Other suitable materials for an outer gasket can include, but are not limited to, rubber, or neoprene.

In this embodiment, an outer gasket can be a neoprene ring-shaped piece approximately 0.125 inches (3.2 mm) thick. The inner diameter of this embodiment of an outer gasket can be approximately 8 inches (200 mm) and the outer diameter can be approximately 12 inches (300 mm). Other embodiments of an outer gasket can have greater or lesser dimensions in accordance with the invention.

Figure 4:
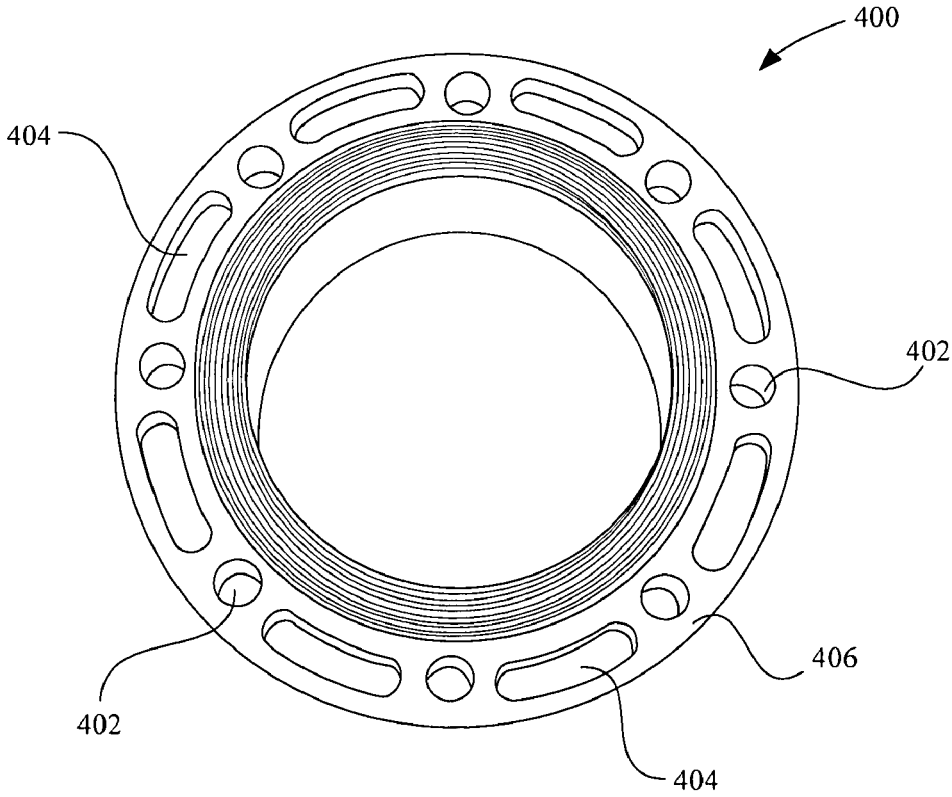
FIG. 4 illustrates an example of an outer port body of a fill port according to one embodiment of the invention.

The outer port body 208, 400 shown in FIGS. 2 and 4 is capable of mounting to the external surface of a flexible container. For example as shown in FIG. 2, the outer port body 208 can mount to the outer surface 228 of the flexible container 216. In the embodiments shown in FIGS. 2 and 4, an outer port body 208, 400 can be a circular-shaped ring or flange-shaped piece. The outer port body 208, 400 can be relatively flat, and can include a series of relatively evenly spaced apart bolt holes 232, 402 machined through the outer port body 208, 400. Between each of the bolt holes 232, 402, one or more cellular surfaces 234, 404 can also be machined or otherwise molded into an inner face 236, 406 of the outer port body 208, 400. The "inner face" is defined herein as the surface of the outer port body facing the portion of material of the flexible container that will be clamped relative to and between the inner port body and the outer port body. The cellular surfaces 234, 404 of the outer port body 208, 400 can be similar to the cellular surfaces 222, 304 described above with respect to the inner port body 202, 300.

In this embodiment, an outer port body can be a ring-shaped flange approximately 1.5 inches (38 mm) thick. The inner diameter of this embodiment of an outer port body can be approximately 8 inches (203 mm) and the outer diameter can be approximately 12 inches (300 mm). Other embodiments of an outer port body can have greater or lesser dimensions in accordance with the invention.

The outer port body 208, 400 shown can also include an outer sleeve 238. The outer sleeve 238 is capable of mounting to a feed line, or otherwise capable of receiving a fill material from a feed line. In one embodiment, the outer sleeve 238 can be extended with a fabric sleeve and clamp assembly, such as 106 and 108 in FIG. 1, and receive a fill material from a feed line such as 104. The outer sleeve 238 shown in FIG. 2 is a cylindrically-shaped piece with an outer diameter substantially similar or the same as an inner diameter of the ring-shaped or flange portion of the outer port body 208, 400. The outer sleeve 238 can be mounted within or to a portion of the outer port body 208, 400, and can extend away from the opposing face 240 of the outer port body. In one embodiment, the outer sleeve 238 can be integrally formed with the outer port body 208, 400.

The connection bolts 210 can be conventional fastening-type devices that operate in conjunction with corresponding nuts 212 or other securing-type devices. In other embodiments, other types of fastening and securing devices can be used in accordance with the invention. Any combination of fastening and securing devices which are capable of clamping some or all of the components of a fill port 200 together to mount the fill port 200 to a flexible container, particularly clamping a surface 214 of a flexible container 216 between an inner port body 202 and an outer port body 208 as shown in FIG. 2, can be used in accordance with embodiments of the invention. In other embodiments, various fastening and securing devices can include, but are not limited to, a clamp, an adhesive, a weld, or a rivet.

In one embodiment, connection bolts can be approximately 0.75 inch (19 mm) diameter bolts with a length of approximately 4 inches (100 mm). In one embodiment, corresponding nuts can tightened to approximately 50 ft/lbs of torque on the respective connection bolts. Other embodiments of connection bolts can have greater or lesser dimensions in accordance with the invention.

In most instances, a hole 244 or series of holes through the surface 214 of the flexible container 216 may be need to facilitate a flow through the fill port 200. In some instances, the fill port 200 shown in FIG. 2 can be installed adjacent to a pre-existing hole 244 or series of holes cut or otherwise fabricated in the surface 214 of the flexible container 216. In these instances, the fill port 200 can be aligned with the hole 244 such that the inner diameters of the fill port components 202, 204, 206, 208 are aligned with the outer diameter of the hole or proximity of series of holes. In other instances, a portion of the surface 214 of the flexible container 216 can be removed after the fill port components 202, 204, 206, 208 are aligned with each other and mounted in proximity to the surface 214 of the flexible container 216. The portion can be facilitated, or cut through the surface 214 of the flexible container 216 using a relatively sharp tool or other cutting or punching device.

Turning back to FIG. 2, a fill port 200 in accordance with an embodiment of the invention can be mounted to a surface of a flexible container in the arrangement shown. The respective bolt holes 220, 226, 230, 232 of the inner port body 202, inner gasket 204, outer gasket 206, and outer port body 208 can be aligned with corresponding bolt holes 242 through the surface 214 of the flexible container 216. A respective connection bolt 210 can be inserted through each series of bolt holes 220, 226, 230, 232 of the components 202, 204, 206, 208 of the fill port 200 and through the bolt holes 242 in the surface 214 of the flexible container 216. When some or all of the connection bolts 210 have been inserted through the fill port 200 and the surface 214 of the flexible container 216, a corresponding nut 212 or other securing device can be mounted onto the respective connection bolt 210 and the components 202, 204, 206, 208 of a fill port 202 can be clamped together. For example, the inner port body 202 and the outer port body 208 can be advanced towards each other and the surface 214 of the flexible container 216 can be clamped between some or all of the components 202, 204, 206, 208 of the fill port 200. As the nuts 212 or other securing devices are tightened or otherwise installed, a clamping or gripping force can be generated and increased as needed to mount the fill port 200 with respect to the surface 214 of the flexible container 216.

Thus, advancing at least the inner port body and the outer port body towards each other causes the inner port body and the outer port body to clamp some or all of the components of the fill port together until a portion of the surface of the flexible container is positioned between the inner port body and the outer port body. When the inner port body 202 is clamped against the inner gasket 204 and inner surface of the flexible container 216, one or more of the cellular surfaces 222 of the inner port body 202 can distribute the associated clamping or gripping forces around some or all of the inner face 224 of the inner port body 202. Likewise, one or more of the cellular surfaces 234 of the outer port body 208 can distribute the associated clamping or gripping forces around some or all of the inner face 236 of the outer port body 208. In this manner, dynamic loads placed on the surface of the flexible container, particularly those around the region of the fill port 200, can be distributed in a relatively even fashion around the circumferences of the inner port body 202 and the outer port body 208 to reduce the possibility of stress concentration points that can cause tears or failure of the surface 214 near the region of the fill port 200.

Figure 5:
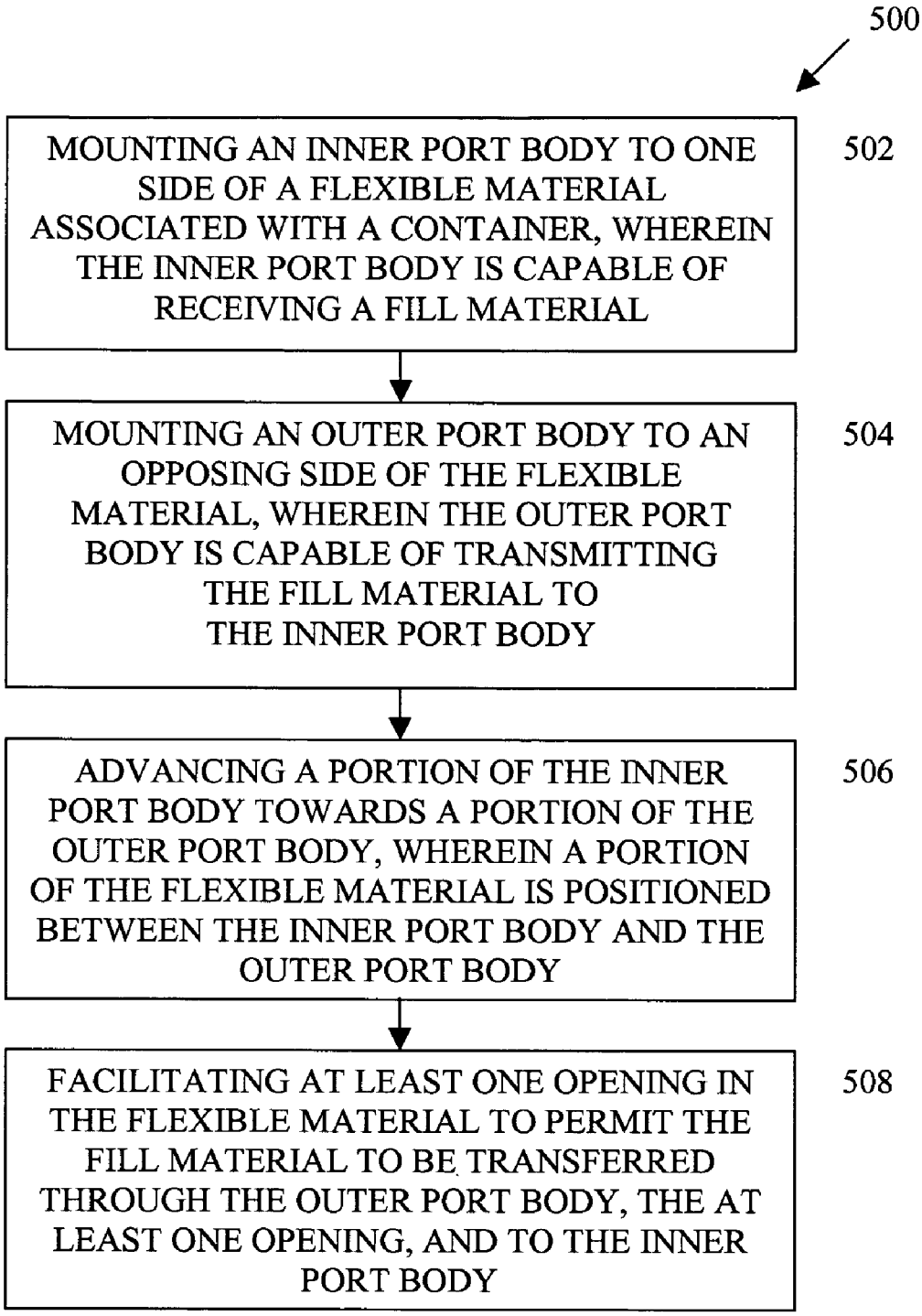
FIG. 5 illustrates an example of a method of use for a fill port in accordance with an embodiment of the invention.

FIG. 5 illustrates an example of a method of providing a fill port for flexible container in accordance with an embodiment of the invention. The method 500 shown in FIG. 5 can be implemented with a fill port 200 shown in FIG. 2. The method 500 can also be implemented with other embodiments of a fill port in accordance with the invention.

The method begins in block 502. In block 502, an inner port body is mounted to one side of a flexible material associated with a container, wherein the inner port body is capable of receiving a fill material.

Block 502 is followed by block 504, in which an outer port body is mounted to an opposing side of the flexible material, wherein the inner port body is capable of transferring the fill material to the outer port body.

Block 504 is followed by block 506, in which a portion of the inner port body is advanced towards a portion of the outer port body, wherein a portion of the flexible material is positioned relative to and between the inner port body and the outer port body.

Block 506 is followed by block 508, in which at least one opening in the flexible material is created to permit the fill material to be transferred through the outer port body, the at least one opening, and to the inner port body. In block 508, the method 500 ends.

Figure 6:
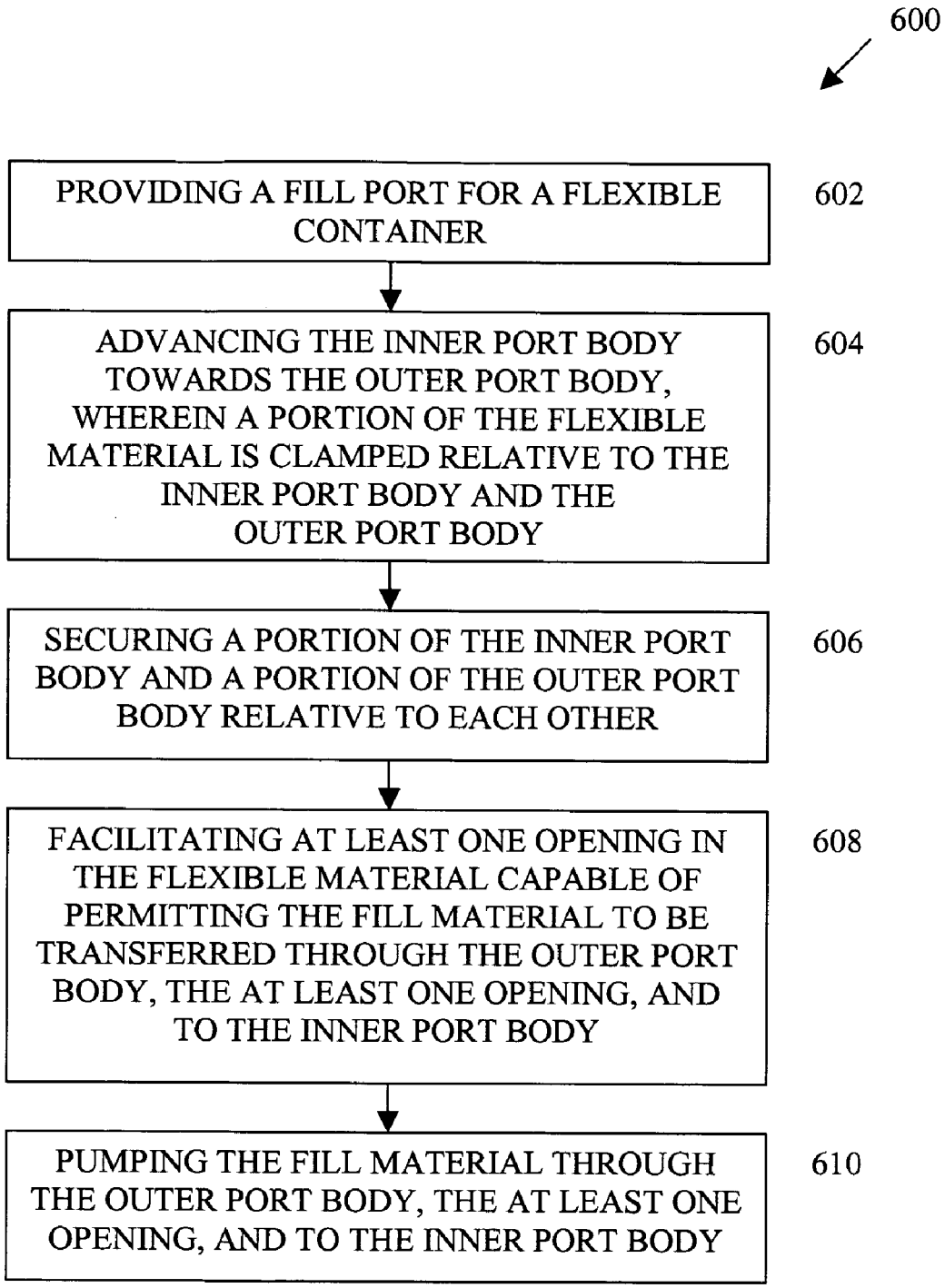
FIG. 6 illustrates an example of a method of installation of a fill port in accordance with an embodiment of the invention.

FIG. 6 illustrates an example of a method of using a fill port with a flexible container in accordance with an embodiment of the invention. The method 600 shown in FIG. 6 can be implemented with a fill port 200 shown in FIG. 2. The method 600 can also be implemented with other embodiments of a fill port in accordance with the invention.

The method 600 begins in block 602. In block 602, a fill port is provided for a flexible container. The fill port can include an inner port body capable of mounting to one side of a flexible material, wherein inner port body is capable of receiving a fill material from the at least one opening. The fill port can also include an outer port body capable of mounting to an opposing side of the flexible material, wherein outer port body is capable of transferring the fill material to the at least one opening. The fill port can also include means for advancing the inner port body towards the outer port body, wherein the flexible material is positioned relative to the inner port body and outer port body, and transfer of the fill material can be facilitated through the outer port body, the opening, and to the inner port body.

Block 602 is followed by block 604, in which the inner port body is mounted to the outer port body, wherein a portion of the flexible material is clamped between the inner port body and the outer port body.

Block 604 is followed by block 606, in which a portion of the inner port body and a portion of the outer port body are secured together.

Block 606 is followed by block 608, in which at least one opening is facilitated in the flexible material capable of permitting the fill material to be transferred through the outer port body, the at least one opening, and the inner port body.

Block 608 is followed by block 610, in which the fill material is pumped through the outer port body, the at least one opening, and the inner port body. In block 610, the method 600 ends.

Another method for installing a fill port on a flexible container can be implemented with a fill port 200 shown in FIG. 2. The method can also be implemented with other embodiments of a fill port in accordance with the invention.

An inner port body is aligned with an inner gasket. For example, inner port body 202 can be aligned with an inner gasket 204, wherein the inner gasket 204 is overlaid onto the inner face 224 of the inner port body 202. The bolt holes 220, 226 of each component 202, 204 can be aligned, and connection bolts 210 can then be inserted through each of the aligned bolt holes 220, 226 and through each component 202, 204.

Next, the inner port body and inner gasket are mounted proximate to the inner surface of the flexible container. For example, the component assembly 202, 204, 210 can be mounted to the inner surface 218 of the flexible container 216. Corresponding bolt holes 242 through the surface 214 of the flexible container 216 can be punched or otherwise cut to permit the connection bolts 210 to protrude through the surface 214 of the flexible container 216 when the component assembly 202, 204, 210 is aligned with the corresponding bolt holes 242.

An outer gasket is then aligned with the inner gasket and the inner port body, and mounted to the outer surface of the flexible container. For example, the outer gasket 206 can be aligned with the inner gasket 204 and the inner port body 202, and mounted to the outer surface 228 of the flexible container 216. Corresponding bolt holes 230 of the outer gasket 206 can be aligned with the connection bolts 210 protruding through the surface 214 of the flexible container 216, and the outer gasket 206 can be mounted to the outer surface 228 and aligned with the inner gasket 204 and inner port body 202.

Subsequently, an outer port body is aligned with the outer gasket and mounted to the outer surface of the flexible container. For example, the outer port body 208 can be aligned with the outer gasket 206, and mounted proximate to the outer surface 228 of the flexible container 216. The bolt holes 232 in the outer port body 208 can be aligned with connection bolts 210 protruding through the surface 214 of the flexible container 216 and through the outer gasket 206. The inner face 234 of the outer port body 208 can be mounted facing the outer gasket 206 and the outer surface 228 of the flexible container 216.

Next, the inner port body and outer port body are advanced towards each other. For example, using a wrench or other tightening device, the corresponding nuts 212 and connection bolts 210 can be tightened such that the inner port body 202 and outer port body 208 are advanced towards each other. A portion of the surface 214 of the flexible container 216 can be clamped in a position relative to and between the inner port body 202 and outer port body 208. As described above in FIG. 2, a portion of the surface 214 of the flexible container 216 within the inner diameter of the fill port 200 can be cut or punched to create a hole 244 to facilitate a flow through the fill port 200 and surface 214 of the flexible container 216. In some embodiments, a pre-existing hole 244 or cut can exist and can be implemented with an embodiment of the fill port 200.

The structures and processes described above illustrate exemplary embodiments of inventive concepts included in the present invention. Other systems and processes are possible. While the invention has been described in detail with particular references to these particular embodiments, variations and modifications can be affected within the spirit and scope of the invention as described in this document. For example, the techniques of the present invention may also be used with other types of containers or filter media. Nothing in this specification is meant to limit, expressly or implicitly, the plain meaning of the terms used in the following claims.

That which is claimed:

1. A system for filling a flexible self-supporting dewatering structure, comprising:

(a) a container comprising a fluid permeable flexible material having at least one opening;

(b) a fill port comprising:

(i) an inner port body comprising an inner face and positioned on a first side of the fluid permeable flexible material to at least partially surround the at least one opening and so that the inner face of the inner port body faces the fluid permeable flexible material; and (ii) an outer port body comprising an inner face and positioned on a second side of the fluid permeable flexible material opposite the first side to at least partially surround the at least one opening and so that the inner face of the outer port body faces the fluid permeable flexible material, wherein the inner face of at least one of the inner port body or outer port body comprises a plurality of cellular surfaces, wherein at least some of the cellular surfaces comprise cavities that do not extend through the inner or outer port body on which they are positioned, wherein the cavities of the at least some of the cellular surfaces are adapted to receive a portion of the fluid permeable flexible material when the inner port body, the fluid permeable flexible material, and the outer port body are secured together and in use.

2. The system of claim 1, wherein the inner port body and the outer port body are substantially ring-shaped.

3. The system of claim 1, further comprising:

(a) an inner gasket positioned at least partially between the inner port body and the fluid permeable flexible material; and (b) an outer gasket positioned at least partially between the outer port body and the fluid permeable flexible material.

4. The system of claim 3, further comprising at least one means for securing the inner port body, the inner gasket, the fluid permeable flexible material, the outer gasket, and the outer port body together, wherein the cavities of the at least some of the cellular surfaces are further adapted to receive a portion of at least one of the outer gasket or inner gasket when the inner port body, the inner gasket, the fluid permeable flexible material, the outer gasket, and the outer port body are secured together and in use.

5. The system of claim 1, further comprising a flow line mounted to the outer port body, wherein the flow line provides fill material to the container via the outer port body.

6. The system of claim 1, wherein the system further comprises a sleeve mounted between the outer port body and a flow line, wherein a fill material can be transmitted from the flow line, through the sleeve and the outer port body and into the container.

7. The system of claim 1, wherein the fluid permeable flexible material comprises a flexible fluid permeable fabric.

8. The system of claim 1, further comprising at least one means for securing the inner port body, the fluid permeable flexible material, and the outer port body together.

9. The system of claim 8, wherein the at least one means for securing comprises at least one bolt and at least one nut.

10. The system of claim 9, wherein the at least one bolt comprises a plurality of bolts and wherein each of the inner port body and the outer port body further comprises a plurality of apertures extending through the inner and outer port bodies, each aperture for receiving one of the plurality of bolts.

11. The system of claim 10, wherein the plurality of apertures are uniformly distributed on at least one of the inner port body or the outer port body and wherein at least some of the plurality of cavities of the at least some of the cellular surfaces are distributed evenly between the apertures.

12. The system of claim 1, wherein at least some of the plurality of cavities of the at least some of the cellular surfaces have a uniform depth.

13. The system of claim 1, wherein the inner face of both the inner port body and the outer port body comprises a plurality of cellular surfaces, wherein at least some of the cellular surfaces do not extend through the inner and outer port bodies on which they are positioned.

14. The system of claim 1, wherein the receipt of a portion of the fluid permeable flexible material in the cavities of the at least some of the cellular surfaces distributes clamping forces around the inner or outer port body on which the cellular surfaces are positioned and reduces stress concentration points in the fluid permeable flexible material.

15. The system of claim 1, wherein the fluid permeable flexible material surrounding the at least one opening is without folds or pleats.

16. A fill port for use with a flexible self-supporting dewatering container comprising a fluid permeable flexible material with at least one opening, the fill port comprising:

(a) an inner port body comprising an inner face for positioning on a first side of the fluid permeable flexible material to at least partially surround the at least one opening and so that the inner face of the inner port body faces the fluid permeable flexible material; and (b) an outer port body comprising an inner face for positioning on a second side of the fluid permeable flexible material opposite the first side to at least partially surround the at least one opening and so that the inner face of the outer port body faces the fluid permeable flexible material, wherein the inner face of at least one of the inner port body or outer port body comprises a plurality of cellular surfaces, wherein at least some of the cellular surfaces comprise cavities that do not extend through the inner or outer port body on which they are positioned, wherein the cavities of the at least some of the cellular surfaces are adapted to receive a portion of the fluid permeable flexible material when the inner port body, the fluid permeable flexible material, and the outer port body are secured together and in use.

17. The fill port of claim 16, wherein the inner port body and the outer port body are substantially ring-shaped.

18. The fill port of claim 16, further comprising:

an inner gasket for positioning at least partially between the inner port body and the fluid permeable flexible material; and an outer gasket for positioning at least partially between the outer port body and the fluid permeable flexible material.

19. The fill port of claim 18, further comprising at least one means for securing the inner port body, the inner gasket, the fluid permeable flexible material, the outer gasket, and the outer port body together, wherein the cavities of the at least some of the cellular surfaces are further adapted to receive a portion of at least one of the outer gasket or inner gasket when the inner port body, the inner gasket, the fluid permeable flexible material, the outer gasket, and the outer port body are secured together and in use.

20. The fill port of claim 16, further comprising at least one means for securing the inner port body, the fluid permeable flexible material, and the outer port body together when the fill port is positioned on the flexible self-supporting dewatering container.

21. The fill port of claim 20, wherein the at least one means for securing comprises at least one bolt and at least one nut.

22. The fill port of claim 21, wherein the at least one bolt comprises a plurality of bolts and wherein each of the inner port body and the outer port body further comprises a plurality of apertures extending through the inner and outer port bodies, each aperture for receiving one of the plurality of bolts.

23. The fill port of claim 22, wherein the plurality of apertures are uniformly distributed on at least one of the inner port body or the outer port body and wherein at least some of the plurality of cavities of the at least some of the cellular surfaces are distributed evenly between the apertures.

24. The fill port of claim 16, wherein at least some of the plurality of cavities of the at least some of the cellular surfaces have a uniform depth.

25. The fill port of claim 16, wherein the inner face of both the inner port body and the outer port body comprises a plurality of cellular surfaces, wherein at least some of the cellular surfaces do not extend through the inner and outer port bodies on which they are positioned.

26. The fill port of claim 16, wherein the fluid permeable flexible material surrounding the at least one opening is without folds or pleats.

27. A fill port for use with a flexible self-supporting dewatering container comprising a fluid permeable flexible material with at least one opening, the fill port comprising:

(a) a substantially ring-shaped inner port body comprising an inner face for positioning on a first side of the fluid permeable flexible material to at least partially surround the at least one opening and so that the inner face of the inner port body faces the fluid permeable flexible material, wherein the inner port body comprises a plurality of apertures and wherein the inner face of the inner port body comprises a plurality of cellular surfaces, wherein at least some of the cellular surfaces comprise cavities that do not extend through the inner port body;

(b) an inner gasket for positioning at least partially between the inner port body and the fluid permeable flexible material;

(c) a substantially ring-shaped outer port body comprising an inner face for positioning on a second side of the fluid permeable flexible material opposite the first side to at least partially surround the at least one opening and so that the inner face of the outer port body faces the fluid permeable flexible material, wherein the outer port body comprises a plurality of apertures and wherein the inner face of the outer port body comprises a plurality of cellular surfaces, wherein at least some of the cellular surfaces comprise cavities that do not extend through the outer port body;

(d) an outer gasket for positioning at least partially between the outer port body and the fluid permeable flexible material; and (e) a plurality of bolts for extending through the apertures of the inner and outer port bodies to secure the inner port body, the fluid permeable flexible material, and the outer port body together when the fill port is positioned on the flexible self-supporting dewatering container, wherein the cavities of the at least some of the cellular surfaces of the outer port body and the inner port body are adapted to receive a portion of the fluid permeable flexible material when the inner port body, the inner gasket, the fluid permeable flexible material, the outer gasket and the outer port body are secured together and in use.

28. The fill port of claim 27, wherein the fluid permeable flexible material surrounding the at least one opening is without folds or pleats.

* * * * *